United States Patent [19]

Vincent

[11] Patent Number: 4,691,931

[45] Date of Patent: Sep. 8, 1987

[54] PROPELLING ROLLER SKATE

[76] Inventor: Yvon M. Vincent, 1 Avenue des Bosquets, 91800 Brunoy, France

[21] Appl. No.: 888,335

[22] Filed: Jul. 23, 1986

[30] Foreign Application Priority Data

Aug. 5, 1985 [FR] France ..... 85 11947

[51] Int. Cl.[4] ..... A63C 17/12

[52] U.S. Cl. ..... 280/11.115; 280/11.2; 280/221

[58] Field of Search ..... 280/11.115, 11.2, 11.21, 280/220, 251, 255, 258, 221

[56] References Cited

U.S. PATENT DOCUMENTS 4,602,801 7/1986 Vincent ..... 280/11.115

FOREIGN PATENT DOCUMENTS 332471 3/1921 Fed. Rep. of Germany ..... 280/11.115
2726961 1/1979 Fed. Rep. of Germany .
2300588 9/1976 France .
2539312 7/1984 France .
2557466 7/1985 France ..... 280/11.115
99784 4/1922 Switzerland .

*Primary Examiner*—David M. Mitchell
*Attorney, Agent, or Firm*—Laurence Brown & Associates

[57] ABSTRACT

Propelling roller skate comprising a selector on which the pedal is articulated and which is adapted to be placed in two positions: a propulsion position and a braking position. The selector is articulated on the brake device which also carries the shaft of the propulsion lever.

The brake device is itself adapted to turn about the drive shaft of the driving wheels. The selector carries a stop finger carrying a brake stop and a propulsion stop cooperating respectively with the brake device and with the propulsion device to prevent the movement which does not correspond to the position selected.

8 Claims, 7 Drawing Figures

PROPELLING ROLLER SKATE

The invention relates to a propelling roller skate comprising a roller frame on which a pedal supporting the foot pivots about a transverse axis from a standby position to operate a two-position selection device controlling either a roller propulsion device or a brake device, some of the components of the propulsion and brake devices cooperating to inhibit, in the selected position, the operation of the device not selected.

French Patents Nos. 2,539,312 and 2,557,466 describe examples of construction of propelling roller skates provided with means permitting the selection, from a standby position, of a propulsion position through the thrust of the heel against the rear of the pedal, and a brake position through thrust against the front of the pedal by the tip of the foot. When a position has been selected, it is not possible to select the other position without passing again through the standby position.

In one example described the selection device consists of parts of the brake and propulsion devices, of which two elements are adapted to bear one above or below the other in order to select the propulsion or brake position, starting from the standby position.

The mechanism permitting the selection and performance of the functions is complex. The relatively large number of parts and the driving of some of them by cables deprive the product of adequate strength and would not permit sufficiently economic commercialization.

The invention seeks to provide simpler and more robust propelling roller skates than those known hitherto.

The skates according to the invention are remarkable in that the selection device is composed of a selector on which the pedal is articulated and which has positioning studs adapted to cooperate with positioning notches provided on the frame, stop snugs adapted to cooperate with the brake device when the selector turns about its pivot, which is carried by said device, in order to select the "propulsion" position, and a stop finger comprising a propulsion stop and a brake stop, the propulsion stop cooperating with a propulsion lever articulated on the brake device, which in turn is articulated on a drive pin about which it is adapted to turn in the "braking" selection position in order to act on the driving wheels, and the brake stop cooperating with a catch for locking the brake device in the "propulsion" selection position, while elastic means are provided for returning the selector to the "standby" position when no pressure is applied to the pedal.

The explanations and the drawings described below by way of example will enable it to be understood how the invention can be put into practice.

Figure 1:
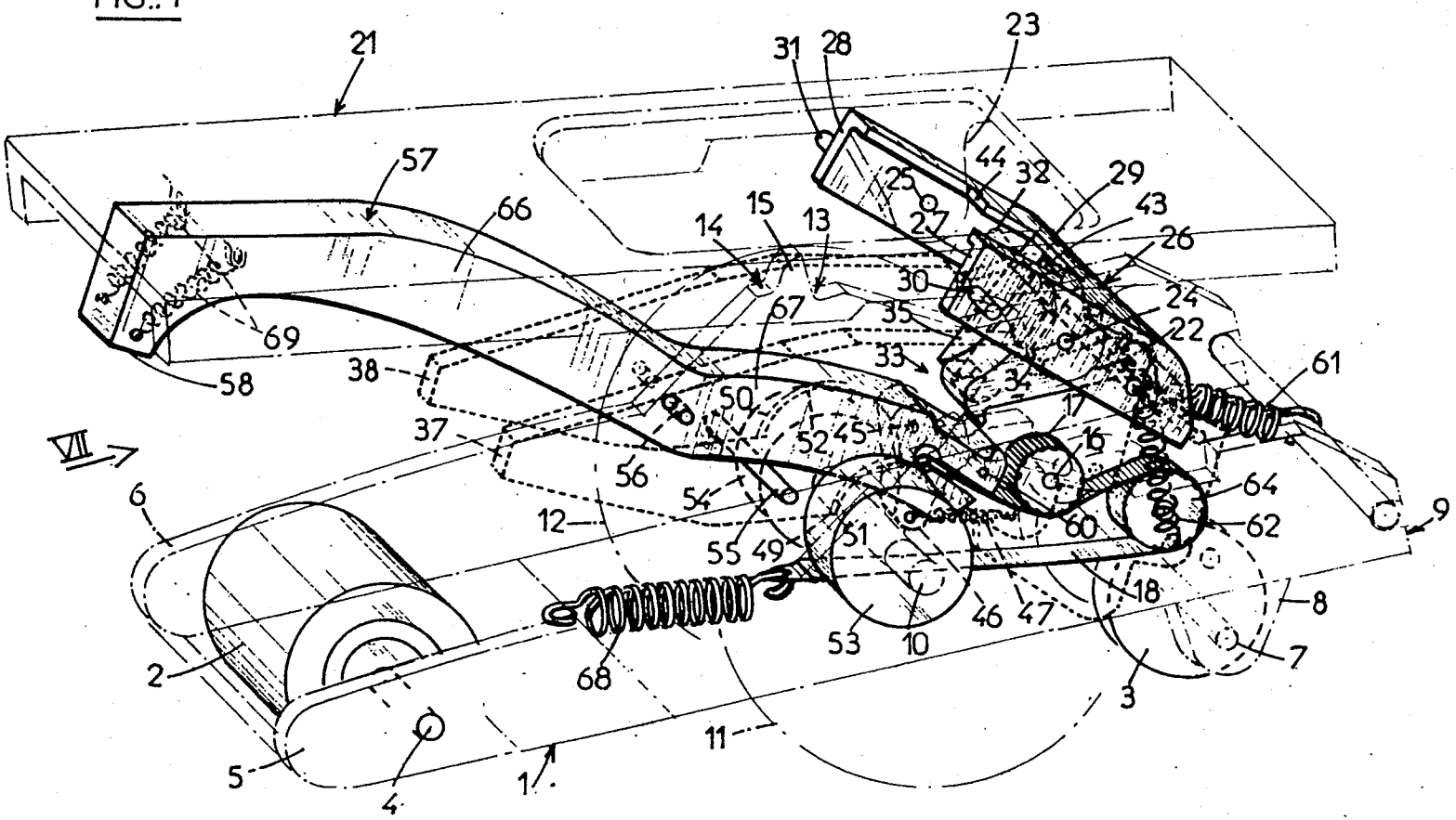
FIG. 1 is a perspective view of the roller skate according to the invention, certain parts being assumed to be transparent.

The propelling roller skate according to the invention is shown in perspective in FIG. 1, with the selection mechanism in the standby position. This position is obtained every time the skate is not in contact with the ground and is suspended under the skater's foot.

The skate comprises a frame on which the wheels are mounted, an operating pedal on which the foot rests, and selection and propulsion mechanisms.

The frame 1 has approximately the form of a U-shaped member carrying at front and rear two loose wheels 2 and 3. The axle 4 of the front wheel 2 is supported directly by the flanges 5, 6 of the frame, while the axle 7 of the rear wheel 3 is mounted on a stirrup 8 fixed to the base 9 of the frame.

The flanges 5, 6 of the frame carry, approximately at midpoint of the length of the frame, a shaft 10 to the ends of which the driving wheels 11, 12 are fixed. According to one characteristic of the skate, when the latter rests on a horizontal surface only the driving wheels 11, 12 and one loose wheel 2 or 3 rest on that surface, in such a manner as to assist the movement leading to the selection of functions.

In the zone close to the shaft 10 the flanges 5, 6 are provided on their outer edge with two positioning notches 13, 14 separated by a snug 15 whose edges form guide slopes for each of the notches.

To the rear of the notches 13, 14 the flanges carry coaxial bores forming bearings for a drive shaft 16, on the central part of which is fixed a part of the drive means of the propulsion device, these means comprising a cogged pulley 17 driven by a cogged belt 18 cooperating with a propulsion lever. The drive shaft 16 carries a toothed drive wheel 19 cooperating with a toothed pinion 20 fixed on the shaft 10 of the drive wheels 11, 12. A freewheel coupling is provided in the kinematic chain of the drive. The drive shaft 16 serves as pivot for the braking device 36.

The pedal 21, to which the skater's foot is fastened, is composed essentially of a plate carrying near its rear end, on its side edges and at right angles to its plane, two lugs 22, 23 provided with bearings cooperating with two coaxial support studs 24, 25 provided on the selector 26 and serving as pivots for the pedal.

Figure 5:
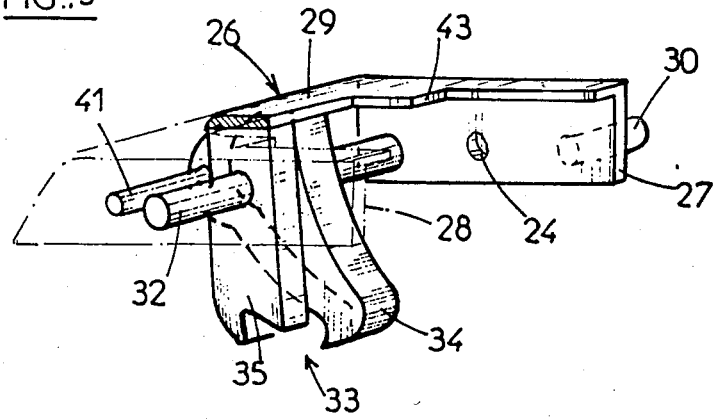
FIG. 5 is a view in perspective of the selector, with the front part broken away.
Figure 6:
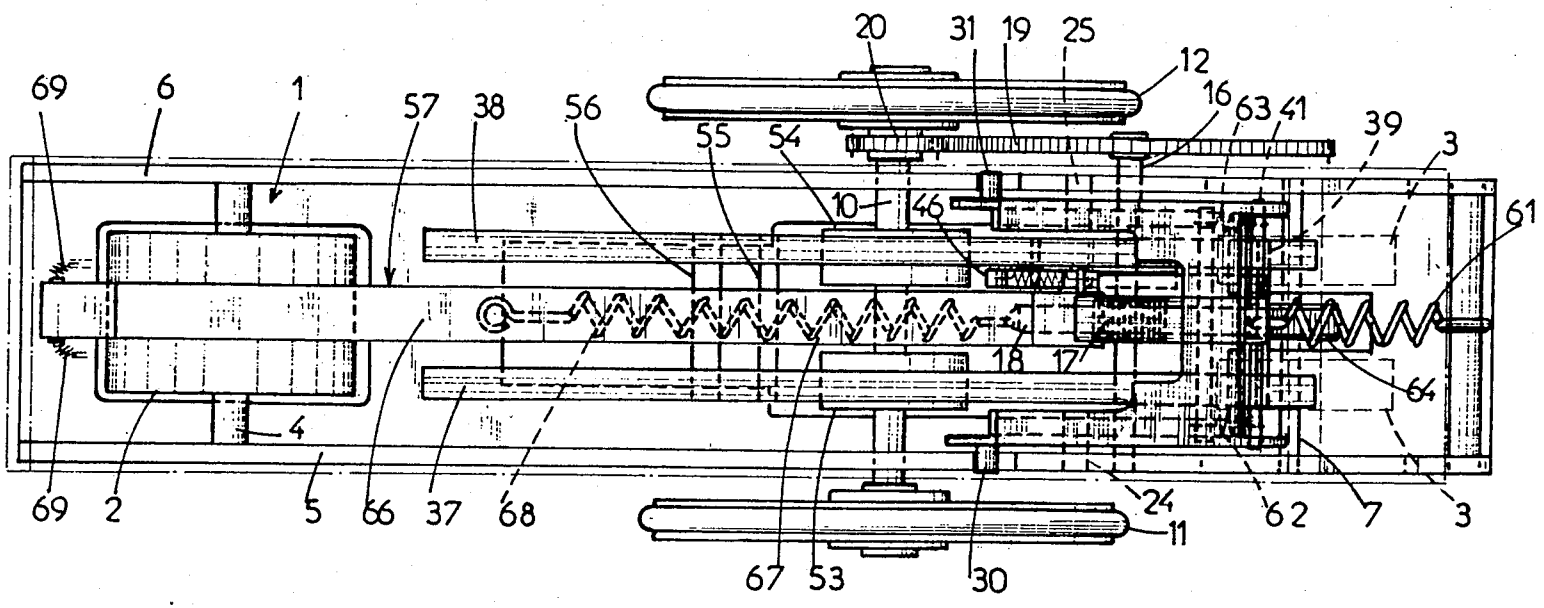
FIG. 6 is a top plan view of the skate with the selector partly broken away.

The selector 26, which is shown on a larger scale and in perspective in FIG. 5, is in the form of a U-shaped part whose side branches 27, 28 are connected by one of their longitudinal edges to the transverse branch 29. Each of the side branches carries, in succession from its free end, a positioning stud 30, 31 and a pedal pivot stud 24, 25, these studs being outwardly directed, an inwardly directed stop snug 43, 44, a selector pivot 32, and, at the rear end, a stop bar 41. The studs, snugs, pivots and stops are perpendicular to the vertical plane of symmetry of the selector.

That face of the transverse branch 29 which is situated inside the side branches carries in a perpendicular plane a stop finger 33 whose end has two transversely offset notches, the openings of which are directed towards the rear and towards the front of the skate and which constitute respectively a propulsion stop 34 and a braking stop 35.

The pivot pin 32 of the selector passes through the finger 33 and makes the connection to a part of the brake device 36, said part being in turn connected to the frame 1 by the drive shaft 16, about which it is free to turn.

The brake device 36 is composed, at least in part, of two plates 37, 38 having approximately the shape of a right-angled trapezium whose acute angle is directed towards the front of the skate, its small base forming the top part. At the bottom, near the rear, the plates are provided with a bore through which the drive shaft 16 passes freely, the device being adapted to turn about said shaft. The plates are held together by braces and are disposed symmetrically with respect to the vertical plane of symmetry of the skate. Near their top edge the plates have a bore through which passes the pivot pin 32 of the selector, and in the top rear corner they have a connecting brace 39 on which is fixed the end of a draw spring 61, whose other end is attached to the frame 1. This spring holds the brake device raised in the "standby" and "propulsion" selection positions by bringing the bottom rear corner 65 to bear against the frame. The top edge of the plates carries, from rear to front, a rear stop notch 40, against which the rear stop bar 41 of the selector 26 comes to bear when the selector is in the "standby" or "braking" position, and a front stop notch 42 against which the stop snugs 43, 44 of the selector come to bear in the "propulsion" position.

The bottom edge of the plates carries, between the bore for the drive shaft 16 and the acute angle, brake means adapted to cooperate directly or indirectly with the driving wheels 11, 12. In the example of embodiment seats 49, 50 are provided which carry brake linings 51, 52 adapted to cooperate with friction disks 53, 54 fixed to the wheel shaft 10. In front of the seats 49, 50 a stop brace 55 is also provided, against which an arm of the propulsion lever 57 comes to lie.

Towards the front the plates carry a brace shaft 56 about which the propulsion lever 57 pivots. According to the characteristics of the device, the brace shaft 56, the drive shaft 16, and the pivot pin 32 of the selector define an isosceles triangle whose apex is represented by the shaft 56.

One of the plates 38 carries in its rear bottom part a pivot pin 45 on which is mounted a catch 46, which is returned to the upper position by a spring 47 fixed on the plate. When the selector is in the propulsion position, this catch cooperates with the brake stop 35 of the selector in the "propulsion" position.

The fastenings of the two return springs 62, 63 fixed to the stop bar 41 of the selector are disposed at the bottom rear end of the plates 37, 38.

The propulsion device comprises a propulsion lever 57 adapted to turn about the shaft 56 between two positions limited by a rear stop 55 and a front stop 58, under the action of the pressure exerted by the pedal 21 at the front end of the lever.

The stops may be made in different forms, and for example the stop 58 may be dispensed with and replaced by the action of the pedal 21 in bearing against the brake device 36.

The rear end of the lever cooperates with a belt adapted to move and thus drive the drive shaft 16. In the example of embodiment a cogged belt 18 driven by the lever passes over a cogged pulley 17 fixed to the drive shaft 16. One end of the belt 18 is attached to a draw spring 68 fixed to the frame 1. In order to permit an adequate travel of the end of the lever 57, the belt passes over a return pulley 64 provided on the frame 1.

The drive shaft 16 carries a toothed wheel 20 cooperating with a toothed pinion 19 fixed to the wheel shaft 10.

The propulsion lever 57 is divided into two arms—a front arm 66 and a rear arm 67—by the pivot 56. In the present embodiment the front arm 66, which cooperates with the pedal 21 driving it, is longer than the rear arm and makes contact with the pedal by means of a surface having a cam profile.

The purpose of this profile is to permit displacement of the point of application of the propulsion force in order that at the commencement of the propulsion the lever arm will be as long as possible so as to reduce the effort required to overcome inertia forces, and that at the end of the stroke the displacement of the end of the lever arm driving the belt will be as great as possible.

A similar effect can be obtained by providing on the arm 66, for example, a retractable roller which comes into action only when the force required for propulsion is sufficiently slight to permit operation with a shorter lever arm.

The front end of the lever 57 carries at the bottom a stop 58 which comes to bear against the frame 1 at the end of the propulsion movement stroke.

The top face of the rear end of the lever forms a hook 59, which is the "standby" position of the selector 26 is vertically in line with the propulsion stop 34.

At this same end the lever carries, on its face facing the plate 38, a stud 60 at right angle to its vertical plane of symmetry and adapted to bear against the catch 46 against the action of the return spring 47 when the selector 26 is in the "standby" and "braking" positions.

The mode of operation of the various component parts of the skate is described below in accordance with the selection made from the standby position.

Figure 2:
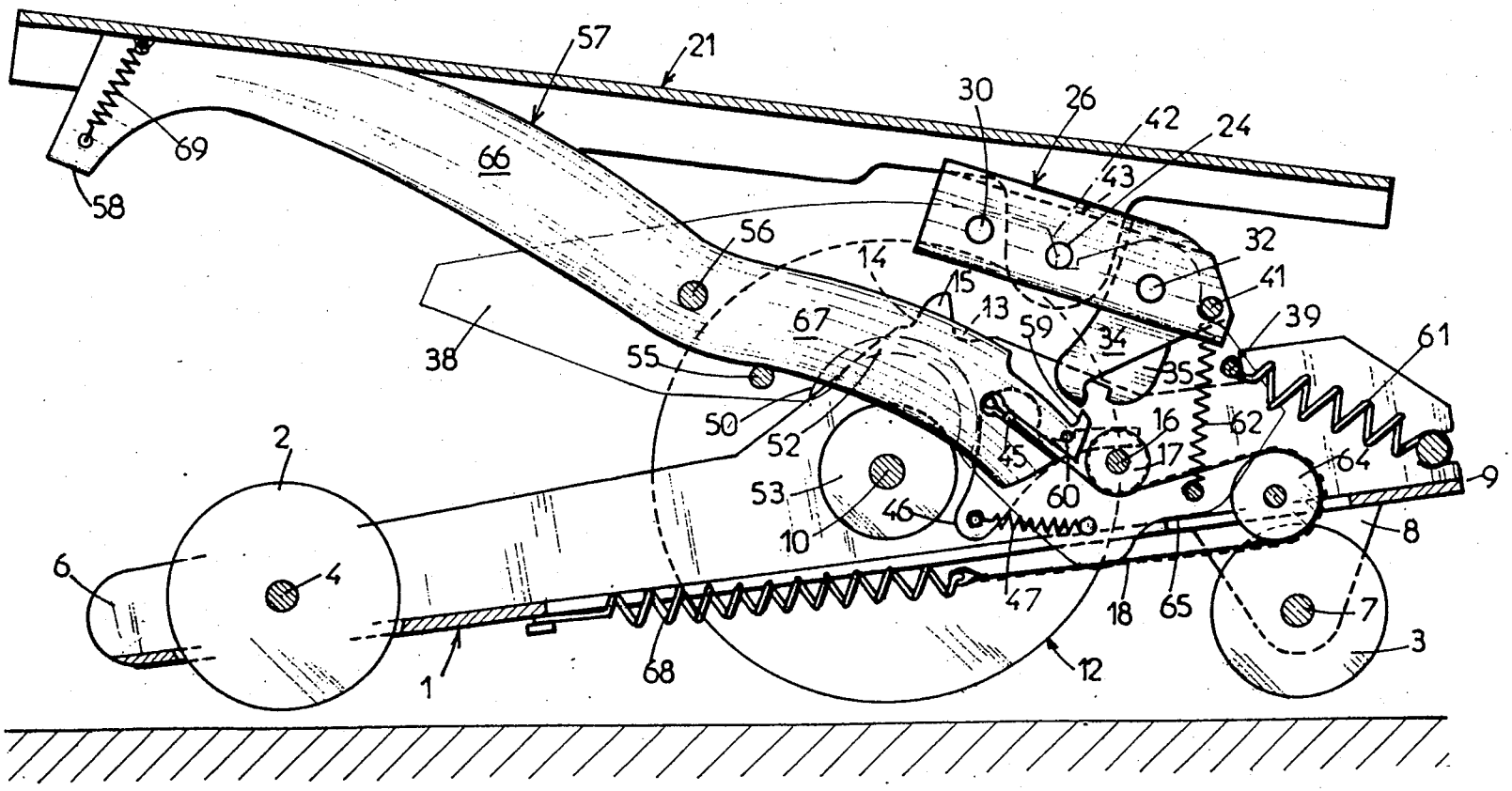
FIG. 2 is a view in elevation, partially broken away longitudinally of the skate, the selection mechanism being in the standby position.

In the "standby" position (FIG. 2) no pressure is exerted on the skate sole 21, which is suspended from the skater's foot. The selector 26 is moved upwards about its axis 32 through the action of the return springs 62, 63, the stop bar 41 being in contact with the stop notch 40 of the brake device 36, which in turn is pivoted upwards about the drive shaft 16 through the action of the spring 61, the rear corners 65 of the plates bearing against the frame. The propulsion stop 34 fixed to the selector is placed vertically in line with the hook 59 on the end of the propulsion lever 57, without engaging therewith. The stud 60 carried by this same end bears against the catch 46 to pivot it downwards against the action of the return spring 47, and to hold it beyond the brake stop 35 carried by the finger of the selector 26.

Figure 3:
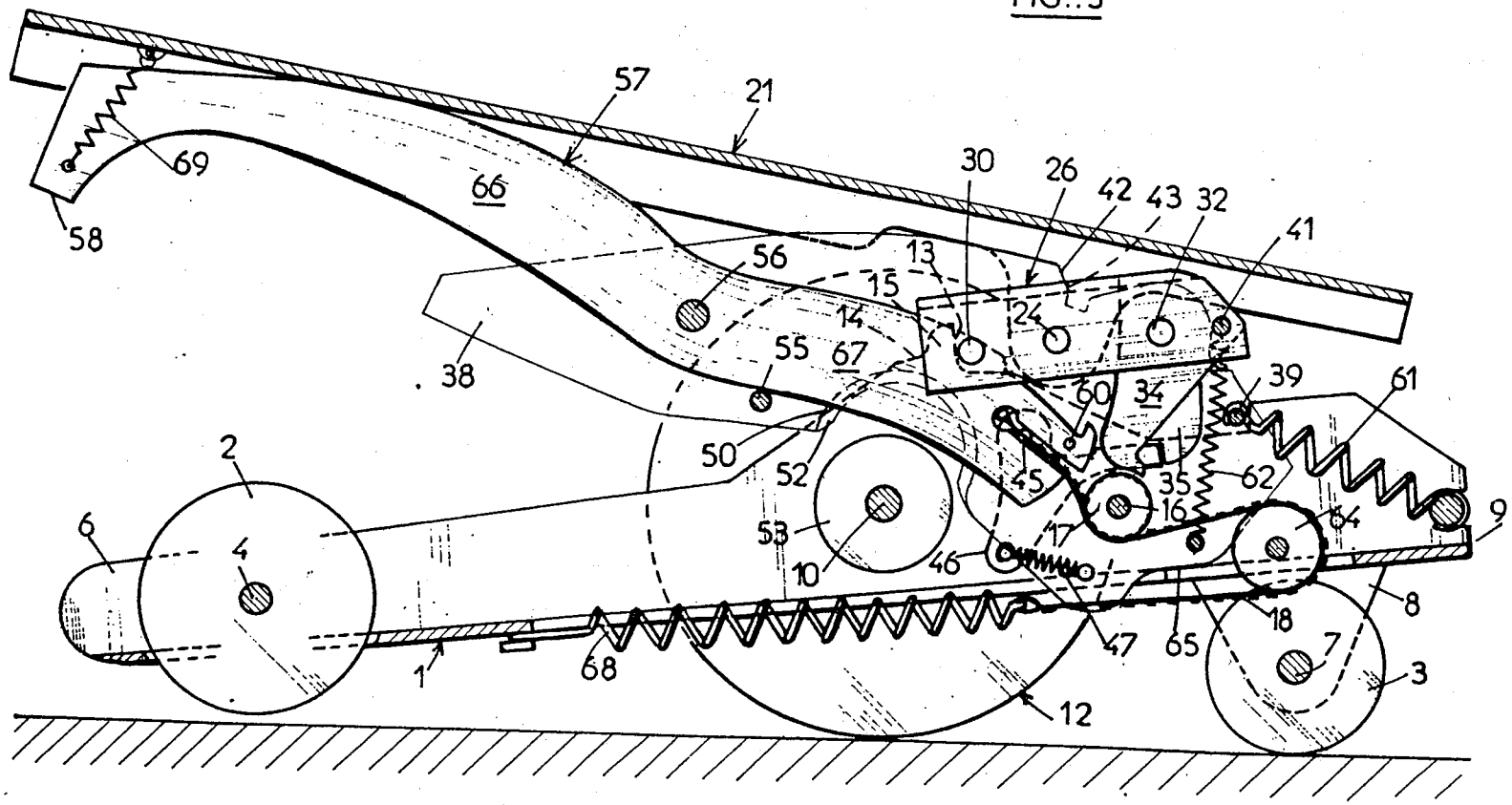
FIG. 3 is a similar view in elevation to that shown in FIG. 2, with the selection mechanism in the propulsion position.
Figure 4:
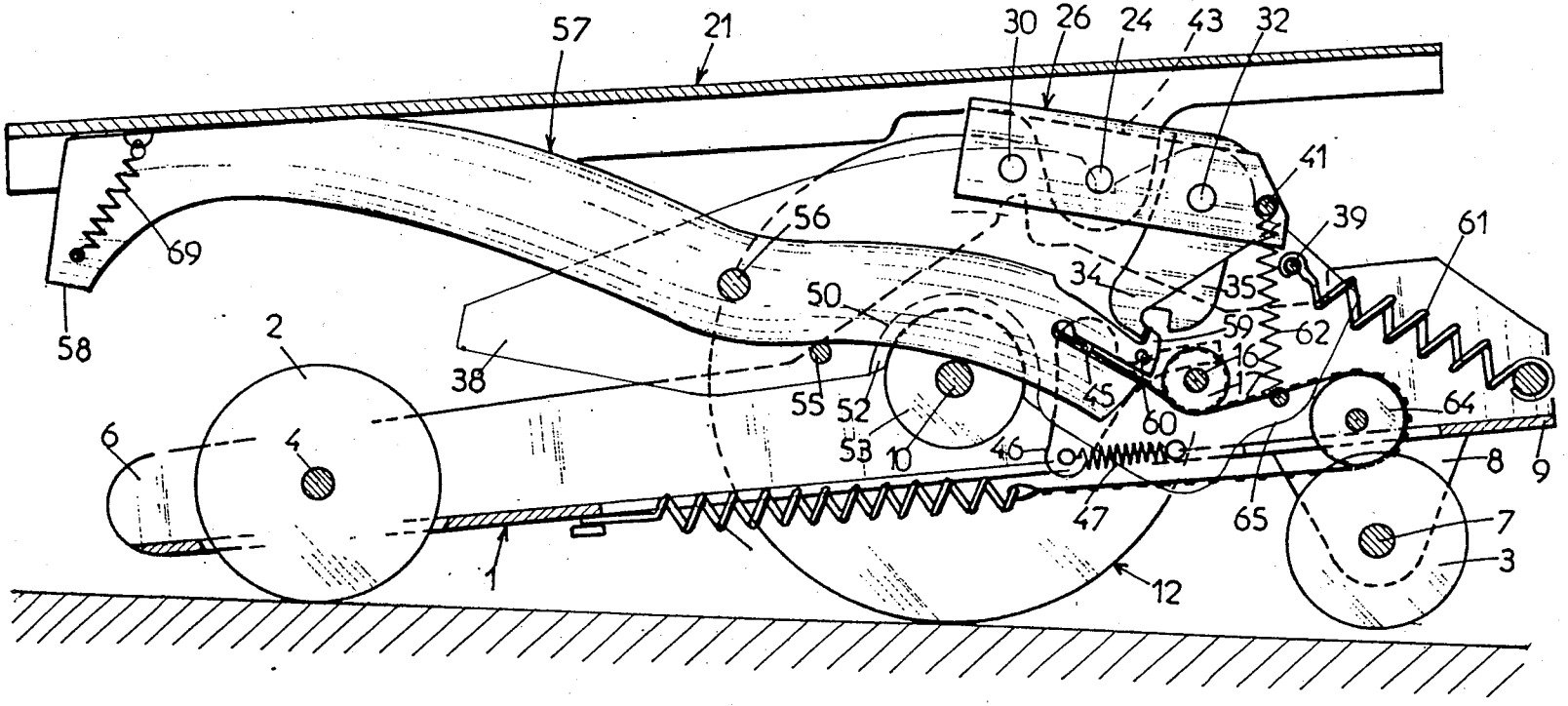
FIG. 4 is a view in elevation similar to that shown in FIG. 2, with the Selection mechanism in the braking position.
Figure 7:
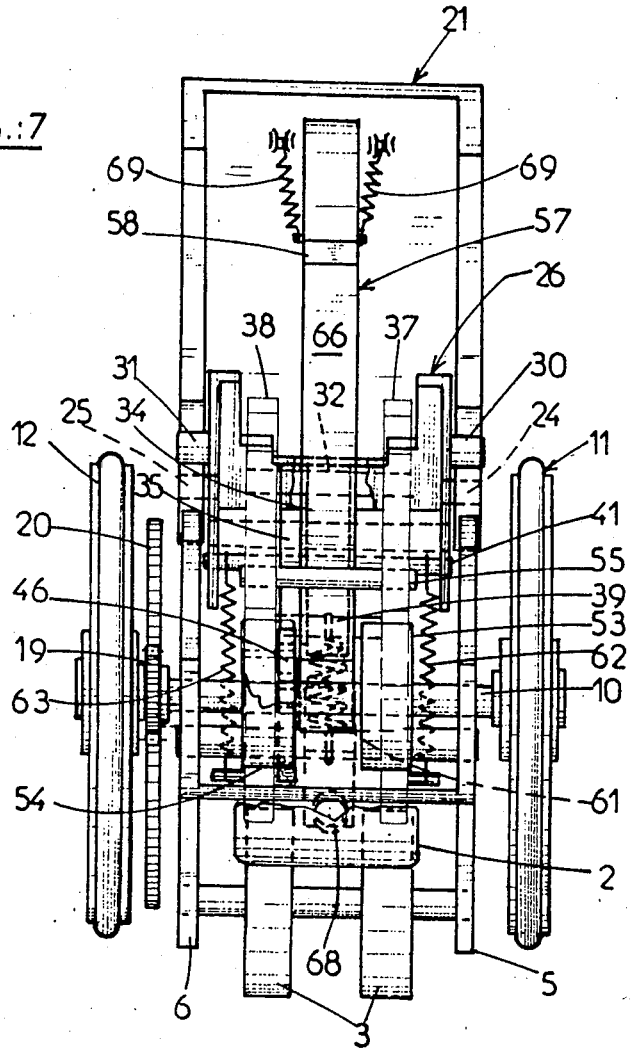
FIG. 7 is a view in section on the line VII in FIG. 1.

The propulsion selection position (FIG. 3) is obtained, as previously explained, by a thrust applied by the heel to the rear of the pedal, which first brings the rear roller into contact with the ground with the weight of the body resting in the support polygon delimited by said rear roller 3 and the driving wheels 11, 12. This thrust pivots the selector about its axis 32 against the action of the return springs 62, 63, in such a manner as to bring the positioning studs 30, 31 into engagement with the positioning notches 13 carried by the frame flanges, and to engage the stop snugs 43, 44 behind the front stop notches 42 of the brake device. This combined action results in the locking of the brake device. The stop finger 33 fixed to the selector has pivoted into a position such that the propulsion stop 34 permits the passage of the hook 59, thus enabling the propulsion lever 57 to turn on its axis 56 through the action of the pedal 21, while the brake stop 35 is positioned above the catch 46, which rises to lock the stop as soon as a movement on the front of the pedal, and therefore a movement of the propulsion lever, is commenced. This movement has the effect of eliminating the pressure of the stud 60 on the catch 46, which is moved back in the upward direction by the spring 47 and comes into engagement with the stop, thus locking the selector in the propulsion position.

Starting from this selected position, the forward pivoting of the pedal, and consequently the downward movement transmitted to the front end of the propulsion lever, turn the latter about the brace pin 56 of the brake device and bring about the reverse movement of the rear end of the lever, thus driving the cogged belt 18 against the action of the draw spring 68 fixed to the frame, and bring about the rotation of the cogged pulley 17 fastened to the drive shaft 16 on which the toothed wheel 19 is fixed, the latter in turn driving the toothed pinion 20 of the shaft 10 carrying the driving wheels 11, 12.

At the end of the propulsion movement, when the front stop 58 of the propulsion lever 57 comes into contact with the frame and the skater raises his foot, the selector returns to the "standby" position when the front end of the lever 57 is returned in the upward direction through the action of the spring 68 and of the springs 69 making the connection to the pedal, owing to the fact that the stud 60 of the propulsion lever bears against the catch 46 and frees the brake stop 35.

Starting from the standby position, the brake position is selected by thrust on the front of the pedal, applied by the tip of the foot. The pedal 21 then bears against the front end of the propulsion lever 57, which drives the brake device 36 and the selector 26 by means of its pivot 32, against the action of the spring 61. The whole arrangement then turns about the drive shaft 16, the positioning studs 30, 31 of the selector coming into contact with the slopes corresponding to the positioning notches 14 provided in the flanges of the frame. The stop finger of the selector is then so positioned that the propulsion stop 34 is situated above the hook 59 of the rear part of the propulsion lever, which is locked there as soon as sufficient force is applied to the front of the pedal, and consequently of the lever, to cause it to turn about its axis. The cooperation of the hook 59 and propulsion stop 34 prevents the operation of the lever and consequently prevents propulsion, while it locks together the lever 57 and the brake device 36 to permit rotation of the latter about the drive shaft 16 and to bring the brake linings 51/52 into contact with the friction disks 53, 54 fastened to the wheel shaft 10.

Once the braking position has been selected, it is possible to apply a heavier or lighter braking force by exerting more or less pressure on the front of the pedal.

Modifications of the shape and/or position of the various elements described in the above embodiment, or their replacement by equivalent devices, also form part of the invention.

I claim:

1. A propelling roller skate comprising a roller frame carrying drive wheels; a drive shaft carried by the frame; pedal means for supporting a foot, the pedal means supported above the frame and pivotable relative to the frame about a transverse axis from a standby position to one of a propulsion position and a braking position; propulsion means carried by the frame; braking means carried by the frame; selection means pivotably supported on a pivot carried by the pedal means and having two positions, namely a "propulsion" position for controlling the propulsion means and a "braking position" for controlling the braking means, wherein the selection means includes a selector on which the pedal is articulated and which selector carries positioning studs adapted to cooperate with positioning notches carried on the frame, stop snugs carried by the selector and adapted to cooperate with the braking means when the selector turns about the pivot carried by the pedal means, in order to select the "propulsion" position, a stop finger carried by the selector for defining a propulsion stop and a brake stop; a propulsion lever pivotally carried by the braking means and cooperatively engageable with the propulsion stop; wherein the braking means is articulated on the drive shaft, about which it is adapted to turn in a "braking" selection position in order to act on the driving wheels, and wherein the brake stop cooperates with a catch for locking the selection means in a "propulsion" selection position, and elastic means connected with the selector for returning the selector to a "standby" position between the propulsion position and the braking position when no pressure is applied to the pedal.

2. A propelling roller skate as claimed in claim 1, in which the selector is a U-shaped member having laterally spaced side branches, extending in planes parallel to the vertical plane of symmetry of the skate, the side branches connected along one of their longitudinal edges to a transverse branch, said side branches carrying positioning studs adjacent their free end and extending outwardly, and pedal support studs extending outwardly of the selector, stop snugs inwardly of the side branches and positioned longitudinally between the positioning studs and the pivot pins, and a stop bar extending transversely and adapted to cooperate with the braking means in the "standby" and "braking" positions, the selector carrying the stop finger on an inner face of the transverse branch and positioned inside the side branches and in a perpendicular plane, the stop finger having an end defined by two stops, one stop for propulsion and one stop for braking which stops are disposed facing one another and offset in a vertical longitudinal plane.

3. A propelling roller skate as claimed in claim 1, in which the braking means includes at least two spaced plates having approximately the shape of a right-angled trapezium whose acute angle is directed forwards and whose small base forms a top surface, said plates including at the rear, near their top surface a bore through which the selector pivot pin passes and, adjacent a bottom surface, a bore through which freely passes the drive shaft about which said device is adapted to turn, and at a front a brace shaft about which the propulsion lever is adapted to pivot, the selector pivot pin and drive shaft bores and the brace shaft forming the angles of an isosceles triangle of which the brace shaft is the apex.

4. A propelling roller skate as claimed in claim 3, in which the top rear edges of the plates include rear stop notches adapted to cooperate with a stop bar provided on the rear end of the selector, and front stop notches adapted to cooperate with stop snugs carried by the selector, and in which the bottom edges of the plates carry stops at the rear ends adapted to engage with the frame, and wherein the plates also include seats carrying brake linings cooperating with friction disks provided for acting on a drive wheel shaft carrying the driving wheels and wherein at least one of the plates carries a catch adapted to cooperate with the brake stop of the selector.

5. A propelling roller skate as claimed in claim 1, in which the propulsion lever includes two arms, namely a front arm and a rear arm, the front arm having a cam profiled surface for contact with the pedal, along which cam profile the point of application of the force transmitted by the pedal to the lever is displaced relative to the lever pivot so that on the commencement of propulsion the first lever arm in contact with the pedal will be as long as possible and will be shortened when the force required for propulsion decreases.

6. A propelling roller skate as claimed in claim 1, in which the propulsion lever carries one end of a drive belt that drivingly engages the drive shaft and is adapted to be displaced and thereby drive the drive shaft, and in which the upper face of the rear end of the lever includes a hook which in the "standby" position of the selector is vertically in line with the propulsion stop of the selector.

7. A propelling roller skate as claimed in claim 3, in which the propulsion lever carries at its rear end, on a face facing the braking means a stud which is at a right angle to said face and is adapted to bear against a catch carried by one of the plates and against the action of a return spring in the "standby" and "braking" positions of the selector.

8. A propelling roller skate as claimed in claim 6, in which the propulsion lever includes a front end and a rear end and the front end of the propulsion lever includes a front stop that is adapted to bear against one of the frame and the braking means at the end of the propulsion movement stroke.

* * * * *